US008267677B2

(12) United States Patent
Forsström

(10) Patent No.: US 8,267,677 B2
(45) Date of Patent: Sep. 18, 2012

(54) GASKET PART FOR A PUMP

(75) Inventor: Jussi Forsström, Anjalankoski (FI)

(73) Assignee: Flowrox OY, Lappeenranta (FI)

( * ) Notice: Subject to any disclaimer, the term of this patent is extended or adjusted under 35 U.S.C. 154(b) by 987 days.

(21) Appl. No.: 12/088,862

(22) PCT Filed: Oct. 3, 2006

(86) PCT No.: PCT/FI2006/000324

§ 371 (c)(1),
(2), (4) Date: Jul. 30, 2008

(87) PCT Pub. No.: WO2007/039666

PCT Pub. Date: Apr. 12, 2007

(65) Prior Publication Data

US 2009/0051118 A1 Feb. 26, 2009

(30) Foreign Application Priority Data

Oct. 3, 2005 (FI) ..... 20050992
Dec. 1, 2005 (FI) ..... 20051230

(51) Int. Cl.
*F01C 19/00* (2006.01)
*F04C 27/00* (2006.01)

(52) U.S. Cl. ..... 418/104; 29/888.021; 29/426.1; 29/426.5; 29/426.6

(58) Field of Classification Search ..... 418/104; 29/888.021, 426.1, 426.5, 426.6
See application file for complete search history.

(56) References Cited

U.S. PATENT DOCUMENTS

| | | | | |
|---|---|---|---|---|
| 2,412,588 | A | 12/1946 | Lauck | |
| 2,931,302 | A | 4/1960 | Dlugos | |
| 3,263,620 | A | 8/1966 | Schofield | |
| 4,060,353 | A * | 11/1977 | Akimoto et al. | 418/104 |
| 4,541,160 | A * | 9/1985 | Roberts | 29/401.1 |
| 4,599,056 | A * | 7/1986 | Crase | 418/48 |
| 5,769,618 | A | 6/1998 | Ono et al. | |
| 5,836,754 | A * | 11/1998 | Ozaki et al. | 418/201.3 |
| 6,227,829 | B1 * | 5/2001 | Wehling et al. | 418/48 |
| 6,868,912 | B2 * | 3/2005 | Proctor | 166/378 |

FOREIGN PATENT DOCUMENTS

| | | |
|---|---|---|
| EP | 0 561 494 A2 | 9/1992 |
| EP | 0 627 557 A1 | 12/1994 |
| JP | 09-264264 | 7/1997 |
| WO | WO 2004/072483 A1 | 8/2004 |

* cited by examiner

*Primary Examiner* — Mary A Davis
(74) *Attorney, Agent, or Firm* — Merchant & Gould P.C.

(57) ABSTRACT

The invention relates to a gasket part for a pump to be used in conjunction with a bearing part (1) of the pump, through which there is arranged a drive shaft (2). According to the invention, the gasket part includes a mechanical gasket (7) and a detachable part (4) of the drive shaft, which detachable part is arranged substantially in conjunction with the bearing part (1) and can be detachably connected between the other parts (3, 5) of the drive shaft; the gasket (7) is arranged in conjunction with the detachable part (4) of the drive shaft; and the detachable part (4) of the drive shaft includes means (8) for arranging it so as to be compacted in the longitudinal direction. Moreover, the invention concerns a method for detaching the gasket part and use of the gasket part.

12 Claims, 2 Drawing Sheets

GASKET PART FOR A PUMP

FIELD OF THE INVENTION

Figure 1:
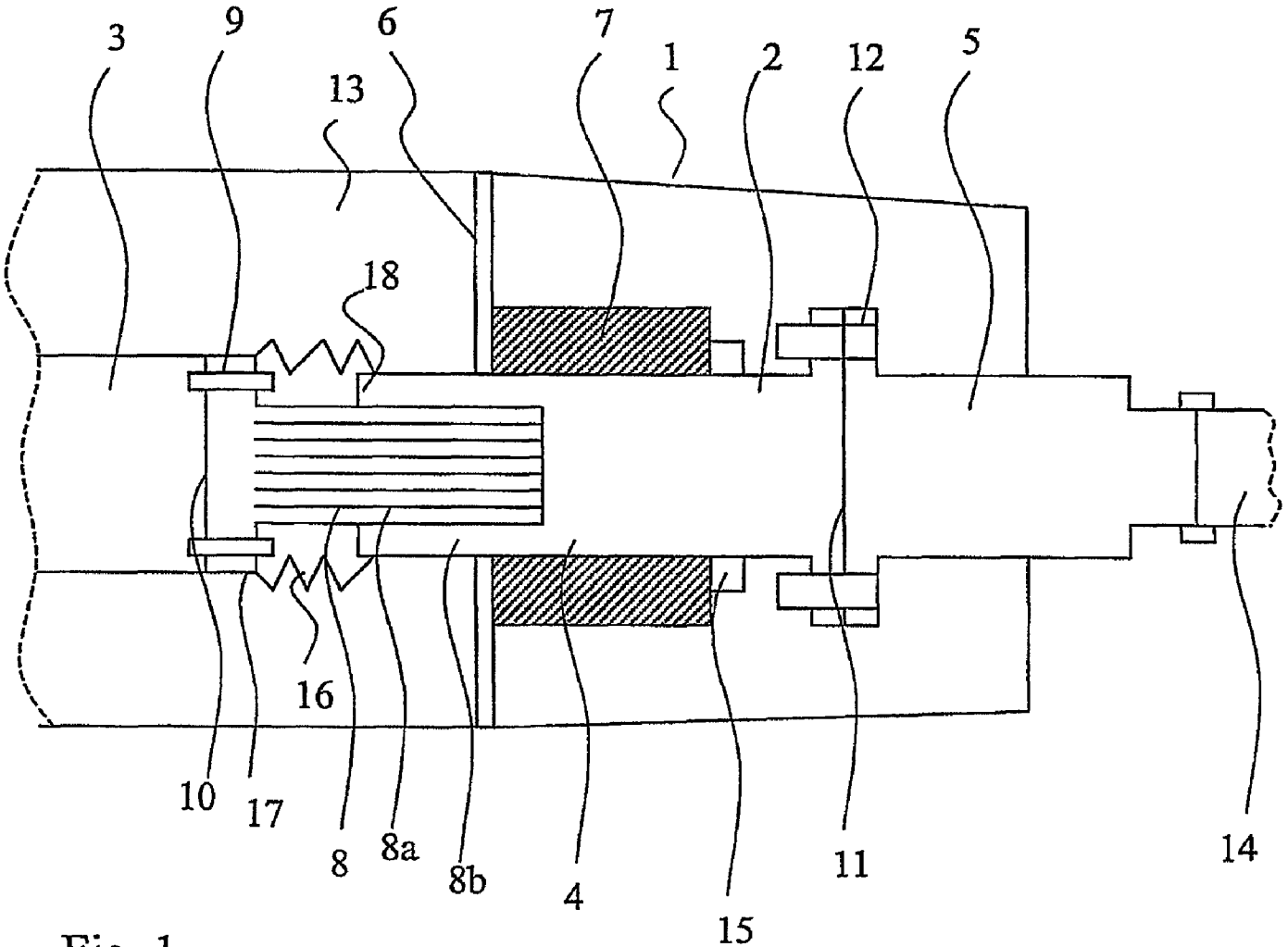

The present invention relates to a gasket part for a pump, a method for detaching the gasket part for a pump, and use of a gasket part for a pump.

BACKGROUND OF THE INVENTION

Various mechanical gaskets to be used in pumps about the drive shaft are known from prior art.

In addition, known from prior art are various screw pumps which use mechanical gaskets. There are typically screw pumps with one, two or three screws. In screw pumps, the substance to be pumped is sucked inside from the suction side and directed out from the pressure side. A drive screw is used to achieve a pressure difference between the suction and pressure side. One known and largely used screw pump type is an eccentric screw pump, specifically used in the transfer of thick fiber suspensions and thick masses.

Depending on the direction of rotation of the bearing part, which attaches the pump body to the power unit, and that of the pump, the mechanical gasket between the suction or pressure side wears in use and must be changed at intervals to maintain the sealing of the pump. To change a gasket is nowadays a slow process because the bearing part of the pump must first be detached from the power unit. Thereafter, the joint between the bearing part and the suction or pressure space must be opened and the drive shaft completely detached, and only then one gets the chance to change the mechanical gasket. This is also expensive considering the time consumed by the shutdown of the process, the disassembly of the pump and change of the gasket.

OBJECTIVE OF THE INVENTION

It is an objective of the invention to eliminate the disadvantages referred to above. One specific objective of the invention is to disclose a novel, better, and easier-to use gasket part, and a gasket arranged in conjunction therewith to be used in pumps. Moreover, it is an objective of the invention to disclose an easy and fast method for changing the gasket.

SUMMARY OF THE INVENTION

The gasket part of a pump in accordance with the invention, the method for detaching it, and the use thereof are characterized by what is described in the claims.

The invention is based on a gasket part for a pump, which can be fitted in conjunction with the bearing part of the pump. At its first part, the bearing part of the pump is connected to the end of the suction or pressure space, depending on the direction of rotation of the pump, and at its second part, to the power unit. Arranged through the bearing part is a drive shaft by means of which the driving output of the power unit is transferred to the drive of the pump. According to the invention, the gasket part includes a mechanical gasket and a detachable part of the drive shaft, which detachable part can be arranged substantially in conjunction with the bearing part and can be detachably connected between the second parts of the drive shaft. The mechanical gasket, which, depending on the direction of rotation of the bearing part and the pump, is a gasket of the connecting point between the suction or pressure space, is arranged in conjunction with the detachable part of the drive shaft. Preferably, the mechanical gasket is arranged to encircle the detachable part of the drive shaft. The detachable part of the drive shaft includes means for arranging it to be compacted in the longitudinal direction.

The gasket part for a pump of the invention achieves good sealing and prevents the substance to be pumped as well as dirt from accessing the bearing part and the power unit.

Herein, the bearing part of the pump means, depending on the direction of rotation of the power unit and the pump, a part between the suction or pressure space.

Preferably, the drive shaft is formed from at least three parts; a first one, a second one, and a third one, detachably connected to one another. The detachable part of the drive shaft; that is, the second part is arranged between the first and third part and substantially in conjunction with the bearing part, and arranged to be detached from the first and third part.

In one embodiment of the invention, the means for arranging the detachable part to be compacted include a first part and a second part, adapted to move in such a manner with respect to one another that the first part can be accommodated within the second part when arranging the detachable part of the drive shaft to be compacted.

In one embodiment, depending on the direction of rotation of the pump, the detachable part of the drive shaft extends to a distance, onto the side of the suction or pressure space of the pump, through the flange joint of the bearing part and the suction/pressure space.

In one embodiment of the invention, the gasket part includes means by which the mechanical gasket can be moved along the detachable part of the drive shaft in the longitudinal direction of the drive shaft. In one embodiment of the invention, the mechanical gasket can be latched to a desired position in the detachable part of the drive shaft by at least one latching means. In one embodiment, the mechanical gasket is connected to the detachable part of the drive shaft, for example, with screws, bolts or the like, which are opened before moving the gasket.

Preferably, the mechanical gasket is arranged in conjunction with the detachable part of the drive shaft and against the joint between the suction/pressure space and the bearing part and not between the joint.

Preferably, the mechanical gasket is arranged to such a position in the detachable part of the drive shaft that when arranging the gasket part so as to go within the bearing part, the gasket presses against the flange joint between the pressure or suction space, depending on the direction of rotation of the bearing part and the pump.

In one embodiment of the invention, the detachable part of the drive shaft is connected to the second parts by connecting means, such as connectors, screws, bolts, flanges, combinations of these, or the like. Preferably, arranged at both ends of the detachable part of the drive shaft are connecting means, such as combinations of a flange/screw, to connect the detachable part of the drive shaft to the second parts of the drive shaft.

In one embodiment of the invention, the gasket part includes a flexible additional gasket which is arranged to be flexible in the longitudinal direction of the drive shaft and adapted to protect the means for arranging the detachable part of the drive shaft to be compacted. In one embodiment, the flexible additional gasket is arranged in a bellows-like shape. Preferably, the length of the flexible additional gasket is adapted so that the detachable part of the drive shaft, which is to be arranged to be compacted, can be moved through its entire length from a minimum length to a maximum length.

In one embodiment of the invention, the flexible additional gasket is placed between the first end of the detachable part of the drive shaft and the mechanical gasket. In another embodiment, the flexible additional gasket is placed between the first end of the detachable part of the drive shaft and the first end of the second part of the compacting means. The additional gasket can be connected to the gasket part by connecting means known per se.

The flexible additional gasket may have been formed from any durable material suitable for the purpose.

A flexible additional gasket prevents the substance to be pumped as well as dirt from accessing the area of the compacting means of the detachable part of the drive shaft, thereby maintaining the compressibility irrespective of the conditions and the substance being pumped.

In one embodiment of the invention, the mechanical gasket comprises at least one sealing ring, such as an O ring seal, adapted to encircle the detachable part of the drive shaft to achieve sealing.

In a preferred embodiment, the mechanical gasket included in the gasket part is so selected that the inner surface of the gasket encircles the part of the drive shaft suitably tightly. Preferably, the sealing ring is placed in a groove arranged in conjunction with the inner surface of the gasket.

Further, the invention concerns a method for detaching a gasket part for a pump as described above. In the method, the latching of the gasket is opened; the detachable part of the drive shaft is detached from the other parts, and the detachable part of the drive shaft is arranged to be compacted. Similarly, the gasket part of the pump is put in place in a corresponding manner, but in reverse order.

In one embodiment of the invention, the gasket is moved along the detachable part of the drive shaft to a desired position in the longitudinal direction of the drive shaft.

In a preferred embodiment, arranged in the outer housing of the bearing part is an opening via which the detachable part of the drive shaft together with the mechanical gasket can be detached from the other parts of the drive shaft, and can be arranged to be compacted in the longitudinal direction and taken out of the bearing part, and via which the detachable part of the drive shaft together with the gasket can be accommodated within the bearing part, and can be arranged to assume a normal size in the longitudinal direction and attached to the other parts of the drive shaft. In one embodiment, the opening arranged in the outer housing of the bearing part can be closed when necessary.

When the detachable part of the drive shaft together with the mechanical gasket is taken out of the pump body, the gasket is usually changed or replaced. The gasket can also be repaired and cleansed only. The detachable part of the drive shaft is changed less frequently, although due to the structure in accordance with the invention it is also possible.

In one embodiment of the invention, the detachable part of the drive shaft is detached from the other parts of the drive shaft prior to arranging the detachable part of the drive shaft to be compacted. In one embodiment, the detachable part of the drive shaft is detached from one part of the drive shaft prior to arranging the detachable part of the drive shaft to be compacted, and then the detachable part of the drive shaft is detached from the other part of the drive shaft.

In one embodiment, the power unit to be attached to the pump is an electric motor or some other actuator. The drive shaft is rotated by means of the power unit, thereby transmitting the driving output of the pump to the drive screw or rotor. While rotating, the drive screw or rotor delivers the substance to be pumped from the suction side to the pressure side.

The gasket part for a pump in accordance with the invention is used in conjunction with pumps, preferably screw pumps, more preferably in conjunction with eccentric screw pumps. Advantages of eccentric pumps include non-pulsating flow and low shear.

The gasket part of the invention enables fast, inexpensive and simple change of the gasket in a pump without the need for disassembling the pump body or detaching the power unit. Thanks to the invention, the maintenance time is made shorter and the maintenance costs are also reduced.

Further, the invention has the advantage that the mechanical gasket and the part of the drive shaft can be arranged to form one whole, making the changeable part of the pump easier to handle. In that case, the structure of the mechanical gasket can be made more simple and better. For example, the part of the gasket that is pressed against the flange between the bearing part and the suction/pressure space can be reduced, thereby also reducing the manufacturing costs.

The gasket part of the invention is applicable to be used in any target of use and conditions in pumps designed for the pumping of various fluids, suspensions, rigid masses or the like, for example, in paper and pulp industry, treatment of waste waters, as well as in various processes of chemical industry.

LIST OF FIGURES

Figure 2:
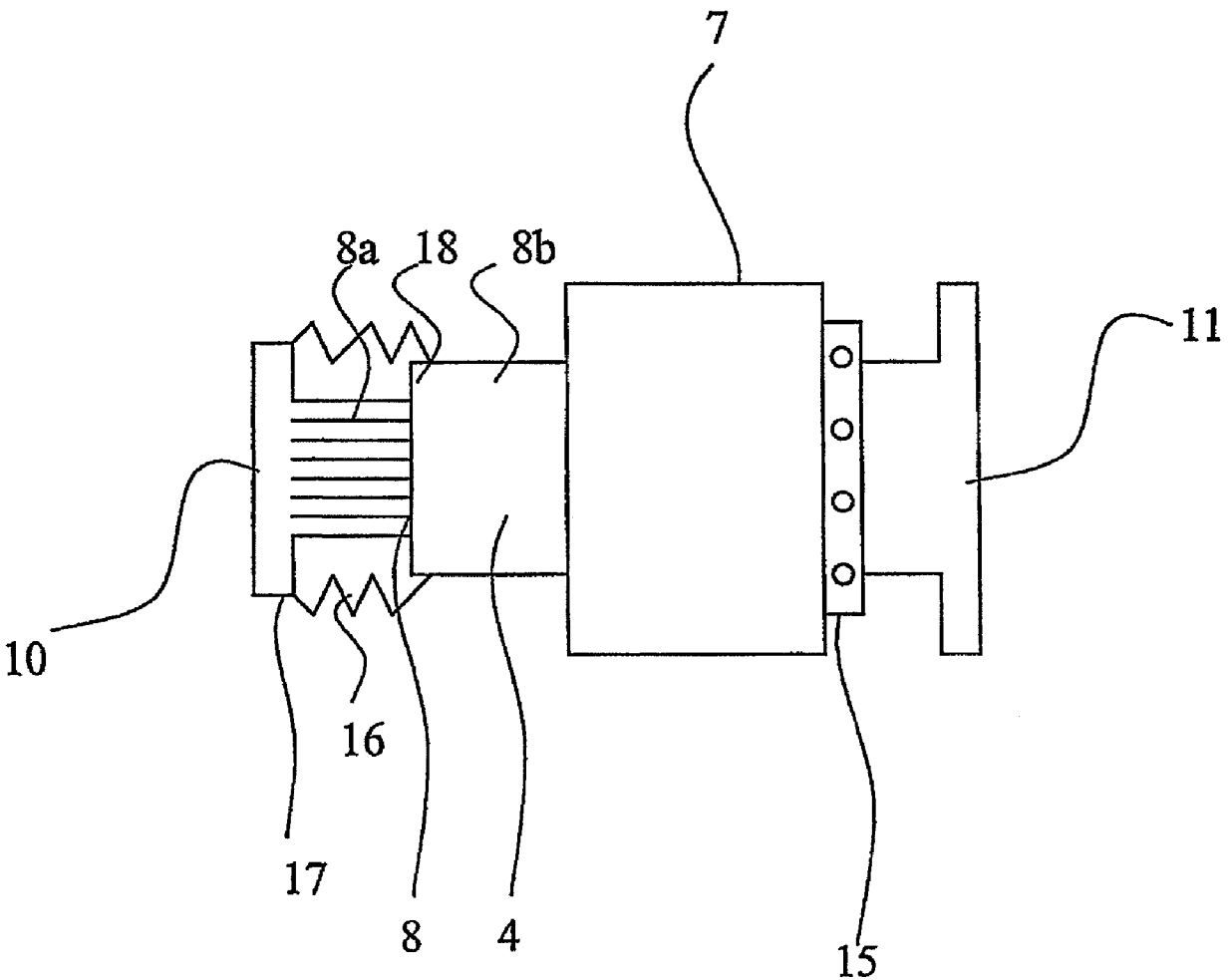

In the following section, the invention will be described by means of detailed examples of its embodiments with reference to the accompanying drawings, in which FIG. 1 is a cross-sectional view illustrating one gasket part for a pump in accordance with the invention; and FIG. 2 is a side view illustrating one gasket part for a pump in accordance with the invention.

DETAILED DESCRIPTION OF THE INVENTION

FIG. 1 is a longitudinal cross-sectional view of the structure of a gasket part for an eccentric screw pump, according to the invention, the gasket part being accommodated within the bearing part. FIG. 2 is a side view illustrating the gasket part of the invention.

In the eccentric screw pump of FIG. 1, the bearing part 1 is attached by a flange joint at its first end to a suction space 13. Attached to the second part of the bearing part is an electric motor 14, from which the driving output of the power unit 14 is transmitted by a drive shaft 2 to a rotor placed within a screw channel. In the eccentric screw pump shown in the embodiment of FIG. 1, the substance to be pumped is sucked into the suction space of the pump through a suction inlet. From the suction space, the substance is introduced into the screw channel having at least one drive screw or rotor. From the screw channel, the substance is led through the outlet of the pressure side out of the pump into a space with a higher pressure.

In the embodiment of FIG. 1, the drive shaft 2 is formed from a first 3, a second 4 and a third 5 part, joined to one another by screw/flange joints 9, 12 so that the second part 4 is disposed between the first 3 and the third part 5, and can be easily detached from the first 3 and the third 5 part. The connecting point 10 between the first 3 and the second 4 part is arranged substantially in the area of the connecting point 6 between the suction space 13 and the bearing part 1, extending to a distance onto the side of the suction space 13. The connecting point 11 between the second 4 and the third 5 part of the drive shaft is accommodated within the bearing part 1.

The gasket part for a pump of the invention as shown in FIGS. 1 and 2 includes a mechanical gasket 7 and a second part 4 of the drive shaft. The mechanical gasket 7 acts to seal the flange joint 6 between the bearing part 1 and the suction space 13. The mechanical gasket 7 is arranged to encircle the second part 4 of the drive shaft and so as to be pressed against the flange joint 6. The inner diameter of the mechanical gasket 7 is so selected that the inner surface of the gasket tightly encircles the second part 4 of the drive shaft. Arranged in the inner surface of the mechanical gasket 7 is a groove with an o ring seal to encircle the second part 4 of the drive shaft.

The gasket part of the pump includes means (not shown in the figures) by which the mechanical gasket 7 is arranged to be moveable along the second part 4 of the drive shaft in the longitudinal direction of the drive shaft 2. Arranged in the second part 4 of the drive shaft is a slotted structure along which the gasket 7 can be moved. The gasket 7 can be secured by screws 15 to a desired and predetermined position in the second part 4. The screws are opened prior to moving the gasket.

Structures of mechanical gaskets are known per se and are therefore not described in greater detail herein. In conjunction with the invention, it is possible to use any known gasket.

The second part 4 of the drive shaft includes means 8 for arranging the detachable part 4 of the drive shaft to be compacted in the longitudinal direction. The means 8 include a first part 8*a* and a second part 8*b*, adapted to move with respect to one another so that the first part 8*a* can be placed within the second part 8*b* when arranging the detachable part 4 of the drive shaft to be compacted. The means 8 are disposed substantially on the side of the suction space 13. The means 8 include a slot/opposing piece structure by which the rotation of the first 8*a* and the second part 8*b* with respect to one another is prevented.

The gasket part includes a flexible additional gasket 16 arranged in a bellows-like shape, arranged to be flexible in the longitudinal direction of the drive shaft 2 and adapted to protect the means 8. In the embodiment of the figures, the bellows-like additional gasket 16 is placed between the first end 17 of the detachable part 4 of the drive shaft and the first end 18 of the second part 8*b* of the compacting means.

In the method of the invention, to detach the gasket part of the pump, the latching of the gasket 7 is first opened by unscrewing the screws 15. Then, the gasket 7 is moved along the second part 4 of the drive shaft to a desired position toward the power unit 14 in the longitudinal direction of the drive shaft. Thereafter, the second part 4 of the drive shaft is detached from the first part 3 of the drive shaft by opening the screw-flange joint 9; and the second part 4 of the drive shaft is arranged to be compacted by means 8 by opening the latching and by placing the first part 8*a* within the second part 8*b*. Finally, the second part 4 of the drive shaft is detached from the third part 5 of the drive shaft by opening the screw-flange flange joint 12. The gasket part of the pump is fastened in reverse order.

In a preferred embodiment, arranged in the outer housing of the bearing part 1 of the pump is an opening via which the gasket part of the invention can be detached from the other parts 3 and 5 of the drive shaft and taken out of the bearing part, and via which the gasket part can be accommodated within the bearing part and attached to the other parts of the drive shaft.

The embodiments of the invention are not limited to the examples referred to above; instead, they can vary within the scope of the accompanying claims.

The invention claimed is:

1. A gasket part for a pump to be used in conjunction with a bearing part of the pump, through which there is arranged a drive shaft, wherein the gasket part includes a mechanical gasket and a detachable part of the drive shaft, which is arranged substantially in conjunction with the bearing part and which can be detachably coupled between other parts of the drive shaft; the mechanical gasket is arranged in conjunction with the detachable part of the drive shaft; and the detachable part of the drive shaft includes means for arranging it so as to be compacted in the longitudinal direction of the drive shaft, wherein the gasket part further includes a flexible additional gasket arranged to be flexible in the longitudinal direction of the drive shaft and adapted to protect the means for arranging the detachable part of the drive shaft so as to be compacted; wherein the means for arranging includes a first part and a second part, of which the first part can be accommodated within the second part when arranging the detachable part of the drive shaft so as to be compacted.

2. The gasket part for a pump as defined in claim 1, wherein the mechanical gasket is constructed to move along the detachable part of the drive shaft in the longitudinal direction of the drive shaft.

3. The gasket part for a pump as defined in claim 1, wherein the mechanical gasket can be latched to a desired position in the detachable part of the drive shaft by at least one latching means.

4. The gasket part for a pump as defined in claim 1, wherein the detachable part of the drive shaft is connected to the other parts by screw/flange joints.

5. The gasket part for a pump as defined in claim 1, wherein the flexible additional gasket is arranged in a bellows shape.

6. The gasket part for a pump as defined in claim 1, wherein the flexible additional gasket is placed between the first end of the detachable part of the drive shaft and the mechanical gasket.

7. The gasket part for a pump as defined in claim 1, wherein the flexible additional gasket is placed between the first end of the detachable part of the drive shaft and the first end of the second part of the means for arranging.

8. The gasket part for a pump as defined in claim 1, wherein the mechanical gasket in constructed to encircle the detachable part of the drive shaft to achieve sealing.

9. A method for detaching a gasket part for a pump to be used in conjunction with a bearing part of the pump, through which there is arranged a drive shaft, wherein the gasket part includes a mechanical gasket and a detachable part of the drive shaft, which is arranged substantially in conjunction with the bearing part and which can be detachably coupled between other parts of the drive shaft; the mechanical gasket is arranged in conjunction with the detachable part of the drive shaft; and the detachable part of the drive shaft includes means for arranging it so as to be compacted in the longitudinal direction of the drive shaft, wherein the gasket part further includes a flexible additional gasket arranged to be flexible in the longitudinal direction of the drive shaft and adapted to protect the means for arranging the detachable part of the drive shaft so as to be compacted; wherein the means for arranging includes a first part and a second part, of which the first part can be accommodated within the second part when arranging the detachable part of the drive shaft so as to be compacted; wherein the method comprises unlatching the mechanical gasket, detaching the detachable part of the drive shaft, and compacting the detachable part of the drive shaft.

10. The method as defined in claim 9, wherein the mechanical gasket is moved along the detachable part of the drive shaft to a desired position in the longitudinal direction of the drive shaft.

11. The method as defined in claim 9, wherein the detachable part of the drive shaft is detached from the other parts of the drive shaft prior to arranging the detachable part of the drive shaft so as to be compacted.

12. The method as defined in 9, wherein the detachable part of the drive shaft is detached from one part of the drive shaft prior to arranging the detachable part of the drive shaft so as to be compacted; and thereafter, the detachable part of the drive shaft is detached from the other part of the drive shaft.

* * * * *